United States Patent [19]

Musser et al.

[11] 4,031,023

[45] June 21, 1977

[54] LUBRICATING COMPOSITIONS AND METHODS UTILIZING HYDROXY THIOETHERS

[75] Inventors: Jerry Lee Musser, Chardon; Frederick William Koch, Willoughby Hills, both of Ohio

[73] Assignee: The Lubrizol Corporation, Cleveland, Ohio

[22] Filed: Feb. 19, 1976

[21] Appl. No.: 659,454

[52] U.S. Cl. ..... 252/48.2; 252/75; 252/78.1; 252/406

[51] Int. Cl.[2] ..... C10M 1/38

[58] Field of Search ..... 252/48.2, 75, 78.1, 252/406, 47.5, 48.4

[56] References Cited

UNITED STATES PATENTS

| | | | |
|---|---|---|---|
| 2,220,941 | 11/1940 | Moran | 252/48.2 X |
| 2,570,050 | 10/1951 | Eby | 252/48.2 X |
| 2,582,605 | 1/1952 | Richter et al. | 252/48.2 X |
| 2,619,508 | 11/1952 | Mikeska et al. | 252/48.2 X |
| 2,660,563 | 11/1953 | Banes et al. | 252/48.2 X |
| 2,806,884 | 9/1957 | Tapp et al. | 252/48.2 X |
| 2,874,192 | 2/1959 | Cottle et al. | 252/406 X |
| 3,567,782 | 3/1971 | Warner et al. | 252/406 X |

*Primary Examiner*—Delbert E. Gantz
*Assistant Examiner*—Andrew H. Metz
*Attorney, Agent, or Firm*—James W. Adams, Jr.; Edmund C. Ross, Jr.; Daniel N. Hall

[57] ABSTRACT

Lubricating compositions comprising a major amount of a lubricating oil and a minor amount of at least one additive of the formula:

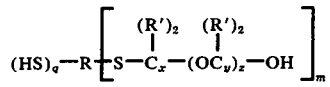

wherein R is a hydrocarbon-based group of up to about 30 carbon atoms and having a valence of $m + q$; each R′ is independently selected from hydrogen and a hydrocarbon-based group of up to about 20 carbon atoms; $x$ and $y$ are independently from 2 to 5; $z$ is from zero to 5; $q$ is from zero to 4 and $m$ is from 1 to 5 with the proviso that $m + q$ is from 1 to 6, have increased resistance to oxidative degradation and anti-wear properties.

25 Claims, No Drawings

LUBRICATING COMPOSITIONS AND METHODS UTILIZING HYDROXY THIOETHERS

This invention concerns lubricating compositions which utilize hydroxy thioethers, methods of using these lubricating compositions and additive concentrates for forming these lubricating compositions. More specifically, this invention relates to lubricating compositions having increased resistance to oxidative degradation, anti-wear properties and other useful properties contributed by certain hydroxy thioethers, methods of using these compositions, and additive concentrates for forming the lubricating compositions.

The lubricating compositions of this invention are suitable for a variety of lubricating applications. Of particular interest are those lubricating compositions of this invention in which the lubricating oil has increased oxidative stability under relatively high-termperature (e.g., 80° C. to 220° C. or higher) lubricating conditions due to the presence therein of one or more hydroxy thioethers described more fully hereafter.

The terminology "lubricating composition" and "lubricating oil composition" as used herein and in the appended claims refers only to transmission lubricating compositions such as automotive automatic and manual transmission fluids, and railroad diesel engine lubricating compositions. Included among these intended lubricating compositions are those which normally come into contact with corrosion-susceptible materials. ("Corrosion-susceptible materials" are those materials which are particularly susceptible to corrosion by sulfur and many sulfur-containing compositions.)

The susceptibility of lubricating oils to oxidative degradation is generally known. However, even if such oils are provided with acceptable oxidative stability, they normally have to meet a variety of other criteria in order to be most useful in certain lubricating applications. Accordingly, efforts continue in order to provide lubricating compositions which not only have acceptable oxidative stability but, furthermore, meet the variety of other demands placed on modern lubricants.

Included among the lubricating compositions of this invention are compositions which are substantially passive under typical operating conditions to corrosion susceptible materials such as silver-containing metals (e.g., solder) which are present in many current automotive automatic transmission systems and other lubricating environments. Accordingly, one aspect of this invention is directed to meeting a need for lubricating compositions which have not only increased oxidative stability at high temperatures, but furthermore, are substantially passive in lubricating environments containing silver/copper alloy solder.

The preparation of the hydroxy thioethers of the type required by this invention has been disclosed in the prior art. Examples of such preparation include those of U.S. Pat. Nos. 2,570,050; 2,776,997 and 2,863,799. These publications are expressly incorporated herein by reference for their disclosure of known procedures for making the hydroxy thioethers as well as their disclosure of specific suitable hydroxy thioethers. Also of interest is German Offenlegungsschrift 2,459,423 and U.S. Pat. No. 3,919,093.

It is a primary object of the invention herein to provide novel lubricating compositions, additive concentrates and lubricating methods. It is a further object of this invention to provide lubricating compositions having oxidative stability and anti-wear properties contributed by certain hydroxy thioethers. It is a still further object of this invention to provide lubricating compositions and methods for lubricating in high temperature environments containing corrosion-susceptible materials. It is another object of the present invention to provide lubricating compositions and lubricating methods suitable for use in lubricating environments having surfaces comprising silver-containing alloys, such as silver/copper-containing solder, which are in contact with the lubricating compositions. These and other objects are accomplished according to the hereinafter disclosure.

Lubricating compositions of this invention comprise a major amount of a lubricating oil and a minor amount of at least one additive of the formula:

Formula I

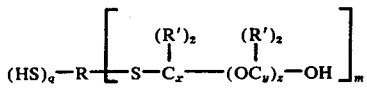

wherein R is a hydrocarbon-based group of up to about 30 carbon atoms and having a valence of $m + q$; each R′ is independently selected from hydrogen and a hydrocarbon-based group of up to about 20 carbon atoms; $x$ and $y$ are each independently an integer of from 2 to 5; $z$ is an integer of from zero to 5; $q$ is an integer of from zero to 4; and $m$ is an integer of from 1 to 5 with the proviso that the sum of $m + q$ is from 1 to 6. Preferred compounds include those wherein R is a saturated hydrocarbon containing from about 6 to about 18 carbon atoms; each R′ is selected from hydrogen or lower alkyl of up to seven carbon atoms, more preferably hydrogen, methyl or ethyl; $q$ is zero; $m$ is 1 to 2, more preferably 1; $x$ is 2; $y$ is 2; and $z$ is zero or 1. Lubricating compositions containing mixtures of two or more of these compounds are, of course, contemplated herein and in the appended claims. (In such mixtures the average value of $x$, $y$, $z$, $q$ and $m$ may be a fractional number within the above broad and preferred limits.) Particularly preferred compounds correspond to those which have a hydroxy group which is in a beta position to the divalent sulfur atoms.

When $q + m$ is greater than 1, R is preferably a group having no more than two divalent sulfur atoms directly attached to any one carbon atom and more preferably only one sulfur atom per carbon atom.

As used herein and in the appended claims, a "hydrocarbon-based" group is a group which is predominantly hydrocarbon in character within the context of this invention. These groups which are suitable for either R (wherein $m$ is 1 and $q$ is zero) or R′ include the following:

a. Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like as well as cyclic groups wherein the ring is completed through another portion of the molecule (that is, any two indicated substituents may together form an alicyclic group as, for example, in the hydroxy thioether of the formula

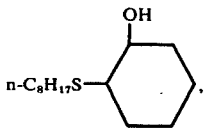

wherein two R's form part of a cyclohexyl moiety). These hydrocarbon groups comprise only carbon and hydrogen atoms and are known to those skilled in the art. They may be saturated or unsaturated but are generally free from acetylenic unsaturation (i.e., —C ≡ C—). Usually they are free from ethylenic unsaturation (i.e., >C=C<) but it should be noted that aromatic unsaturation such as is present in benzene is not considered to be ethylenic unsaturation.

The hydrocarbon groups are preferably aliphatic and more preferably saturated, aliphatic; e.g., alkyl. Examples include such monovalent hydrocarbon groups as: (1) alkyl, such as ethyl, isoctyl, dodecyl, and eicosyl; (2) alkenyl, such as 2-propyl-6-decenyl, 12-octadecenyl, allyl and dodecenyl; (3) cycloalkyl, such as cyclooctyl, and cyclohexyl; (4) cycloalkenyl such as cyclopentenyl, cyclohexenyl and cyclooctenyl; (5) aryl, such as phenyl, naphthyl, and diphenyl; (6) cycloalkylalkyl, such as cyclopropylethyl, and cyclooctylbutyl; (7) cycloalkenylalkyl, such as cyclohexenylpropyl, and cyclopentenylmethyl; (8) arylalkyl, such as benzyl, phenylethyl, and naphthylethyl; (9) arylalkenyl, such as phenylvinylene, and 2-xylylallyl; (10) alkylcycloalkyl, such as trimethylcyclododecyl, and butylcycloheptyl; (11) alkenylcycloalkyl, such as vinylcyclopentyl, butylenecyclooctyl; (12) alkylcycloalkenyl, such as butylcyclohexenyl and methylcyclooctenyl; (13) alkenylcycloalkenyl, such as vinylcyclopentenyl and butylenecycloheptenyl; (14) arylcycloalkyl, such as xylylcyclodecyl, and naphthylcyclohexyl; (15) arylcycloalkenyl, such as phenylcyclohexenyl and tolylcyclodecenyl; (16) alkylaryl, such as eicosylphenyl and dodecylphenyl; (17) alkenylaryl, such as allylphenyl, octenylphenyl, and 2-butenylphenyl; (18) cycloalkylaryl, such as cyclobutylphenyl and cyclohexylnaphthyl; (19) cycloalkenylaryl, such as cyclopentenylphenyl and cyclohexenylphenyl.

When $m + q$ is 2, 3, 4, 5 or 6, examples of R groups include divalent, trivalent, tetravalent, pentavalent or hexavalent groups which are analogous to the next above described monovalent groups except for the additional valence bonds. Examples of such analogous polyvalent R groups are alkylene such as $—(CH_2)_n—$ wherein $n$ is, for example, 12 to 30; lower alkylene-substituted phenylene; hexadecanetriyl; tricosanetetrayl; eicosanepentayl; etc. Generally, however, for economic reasons, mono-valent R groups or divalent R groups are preferred, particularly mono-valent R groups.

b. Substituted hydrocarbon groups; that is, groups containing non-reactive or substantially non-reactive polar or non-hydrocarbon substituents which, in the context of this invention, do not alter the predominantly hydrocarbon character of the group. Representative non-reactive or substantially non-reactive non-hydrocarbon or polar substituents which can be present as a substituent include halo substituents such as chloro, fluoro, bromo, and iodo; nitro; lower alkoxy such as butoxy and hexyloxy; lower alkylthio, such as methylthio, pentylthio and heptylthio; carbohydrocarbyloxy $$\left(\text{i.e., } -\overset{\overset{\displaystyle O}{\|}}{C}-O-\text{ hydrocarbyl}\right),$$

especially carbo (lower) alkoxy $$\left(\text{i.e., } -\overset{\overset{\displaystyle O}{\|}}{C}-O-\text{ lower alkyl}\right).$$

The substitution of and the nature of the substituent on the hydrocarbon-based groups is such that the essentially hydrocarbon character of the group is not destroyed. Thus, in view of this requirement, these groups normally have no more than two such polar or non-hydrocarbon substituents per substituted hydrocarbon group and usually not more than one polar or non-hydrocarbon substituent for about every 15 carbon atoms in the substituted hydrocarbon group. In other words, the substituted hydrocarbon groups are analogous to the hydrocarbon groups discussed and exemplified above except for the presence of certain polar or nonhydrocarbon substituents which do not materially alter the predominantly hydrocarbon nature of the hydrocarbon-based groups.

The hydrocarbon-based groups of this invention are normally "substantially saturated". Terminology "substantially saturated" as used herein is intended to characterize groups free from acetylenic unsaturation (—C ≡ C—) in which there is not more than one ethylenic linkage (>C=C<) for every 12 carbon-to-carbon covalent bonds. The so-called "double bonds" in aromatic rings (e.g., benzene) are not intended to be considered as contributing to unsaturation with respect to the terminology "substantially saturated". Usually there will be no more than an average of about one ethylenic linkage per substantially saturated mono- and polyvalent groups as described hereinbefore. Preferably (with the exception of aromatic rings), all carbon-to-carbon bonds in a substantially saturated group will be saturated linkages; that is, a group will be free from acetylenic and ethylenic linkages.

As used in the present specification and claims, the term "lower", when used in conjunction with terminology designating a chemical group such as alkyl, alkenyl, alkylene and the like, is intended to describe such groups having a total carbon atom content of up to seven. For example, "lower alkyl" includes all straight and branched chain alkyl groups of up to seven carbon atoms.

Especially preferred hydroxy thioethers of this invention comprise compounds wherein;

1. R is a saturated hydrocarbon of from about 6, particularly a saturated aliphatic or alicyclic-substituted aliphatic hydrocarbon, up to about 18 carbon atoms, and more preferably an alkyl of from about eight to about 16 carbon atoms;
2. each R' is independently selected from hydrogen and lower alkyl, especially methyl, and ethyl;
3. $x$ and $y$ are individually 2;
4. $z$ is either zero or 1, more preferably zero;
5. $m$ is 1 or 2, more preferably 1; and
6. $q$ is zero.

Examples of these preferred hydroxy thioethers include

1. $n\text{-}C_8H_{17}SCH_2CHOHCH_3$
2. $n\text{-}C_{12}H_{25}SCH_2CHOHCH_3$
3. $t\text{-}C_{12}H_{25}SCH_2CHOHCH_3$
4. $n\text{-}C_{10}H_{21}SCH_2CH_2OH$
5. $t\text{-}C_9H_{19}SCH_2CH(CH_3)OCH_2CHOHCH_3$
6. $C_{11\text{-}14}H_{23\text{-}29}SCH_2CHOHCH_3$ (i.e., a mixture of hydroxy thioethers)
7. $n\text{-}C_{16}H_{33}SCH_2CHOHCH_3$
8. $n\text{-}C_{14}H_{29}SCH_2CH_2OH$
9. $n\text{-}C_{14}H_{29}SCH_2CH_2OCH_2CH_2OH$ 10. 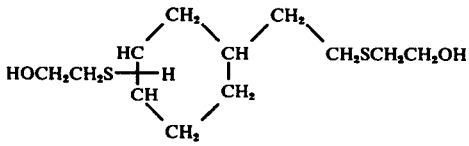

11. $n\text{-}C_{12}H_{25}SCH_2CH_2CH_2OH$

The particular manner in which these hydroxy thioethers are prepared is not a critical aspect of this invention. There are several routes for the preparation of the hydroxy thioethers. For example, hydroxy thioethers for use in this invention can be formed by the reaction of a monomercaptan compound of the formula $R(SH)_p$ (wherein $p$ is 1) with an epoxide. This reaction can be conducted at temperatures ranging from about 30° C. up to just below the decomposition temperature of the reactants or products and is preferably carried out at from about 40° C. to about 200° C. The use of a catalyst facilitates the reaction, and a basic catalyst (e.g., sodium metal or sodium hydroxide) is usually preferred.

At approximately equimolar amounts of monomercaptan and epoxide and at lower reaction temperatures (e.g., 50° C. to 130° C.) a monocondensation product is favored and conforms for the most part to the formula Formula II

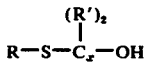

wherein R, R′ and $x$ are as above.

Higher reaction temperatures (e.g., 130°–200° C. or higher), and/or molar amounts of epoxide in excess of the molar amount of monomercaptan generally favor formation of compounds conforming for the most part to the formula Formula III

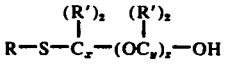

wherein R, R′, $x$, and $y$ are as above-described and $z$ is primarily greater than zero; that is, for the resulting reaction product, the average numerical value of $z$ will be greater than zero although some of the hydroxy thioethers in the reaction product can correspond to the above formula where $z$ is zero.

Any unreacted monomercaptan starting material and/or any unreacted epoxide can remain in the final reaction product and be used in total as an additive for the lubricating oil compositions. Normally, epoxides which can be readily removed by distillation will be removed and recovered. It is generally preferred to use at least a stoichiometrically equivalent amount of epoxide so that all the mercapto groups (i.e., —SH) are converted to thioether groups. The equivalent weight of a mercaptan is based on the number of mercapto groups present. Thus, the equivalent weight of a monomercaptan is its molecular weight; a dimercaptan one-half its molecular weight; a trimercaptan, one-third its molecular weight, etc. The equivalent weight of the epoxides corresponds to their molecular weights. Thus, a stoichiometrically equivalent amount of mercaptan and epoxide corresponds to one mole of epoxide for each equivalent weight of mercaptan.

The mercaptans useful in this preparation can be made by the reaction of an olefin with hydrogen sulfide in the presence of a catalyst. Examples of such preparations are in U.S. Pat. Nos. 3,049,567; 2,928,880; 3,005,030; and 3,032,592 which are hereby incorporated by reference for their teaching of the preparation of suitable mercaptans.

The mercaptans useful in this preparation of the hydroxy thioethers may be primary, secondary or tertiary mercaptans. Many of these materials are commercially available. Tertiary mercaptans prepared from tri- and tetrapropene and di- and triisobutylene base hydrocarbons are preferred.

Suitable epoxides for use in the above preparation of the hydroxy thioethers of this invention include compounds of the formula

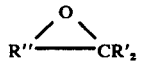

wherein R′ is as above-described and

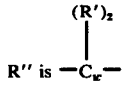

and w is from 1 to 4, preferably 1 or 2, more preferably 1.

Examples of such epoxides include ethylene oxide, propylene oxide, 1,2-epoxyhexane, 1,2-epoxyhexadecane, 1,3-epoxybutane, 3,5-epoxyheptane, 1,2-epoxycyclohexene, 4,5-epoxydecane; 1,2-epoxy-5-oxy-heptane; 1,2-epoxy-6-propyltridecane, oxetanes, 9,10-epoxystearic acid esters, styrene oxides, para-chlorostyrene oxide, and mixtures of two or more of these. Generally, any such epoxide which is stable under the reaction conditions employed may be used but the reactivity of terminal epoxides make them more preferred. The terminal alkylene oxides, especially the terminal lower alkylene oxides are preferred with ethylene oxide and propylene oxide or mixtures thereof being the most preferred epoxides. It should be noted, however, that higher molecular weight epoxides (i.e., $C_{10}$-$C_{20}$ epoxides) are useful for imparting higher levels of oil solubility to the hydroxy thioethers, if desired.

The reaction of the epoxide and mercaptan may be carried out in the presence or absence of added solvents or diluents as a reaction media. One convenient method for effecting a reaction is the addition of the epoxide in small amounts to an excess of mercaptan whereby the mercaptan and the resulting hydroxy thioether can form the reaction media. If desired, the reaction can be continued until nearly all the mercaptan is reacted. When the reaction is conducted in the presence of an added reaction media, i.e., one or more substantially inert, normally liquid, organic diluents or solvents, the total amount of the diluent or solvent used is not critical. Ordinarily this diluent will comprise about 10% to about 80%, and preferably, about 30% to about 70% by weight of the reaction media based on the total weight of the reactants and reactant media in the reaction mixture. By "substantially inert" is meant a material which does not materially interfere in an adverse manner with the reaction nor react in any significant amount under the conditions of the reaction as described and exemplified herein.

Suitable diluents or solvents include aromatic hydrocarbons, aliphatic hydrocarbons, chlorinated hydrocarbons, ethers, and the like, such as benzene, toluene, xylene, heptane, octane, cyclohexane, methylcyclohexane, kerosene, mineral oil, chlorobenzene, n-propylether, methyl n-amylether, and mixtures of two or more of these. Selection of specific, suitable reaction media is within the skill of the art.

The reaction is conveniently conducted at atmospheric pressure, but it also may be conducted at subatmospheric or superatmospheric pressure, if desired. After the reaction is complete, the desired product can be separated, if desired, from the reaction mass by techniques shown in the art. Most solids present are normally removed by filtration. A convenient separation technique utilizes a diatomaceous earth filter aid. Generally, it is not necessary to remove all the catalyst or reaction by-products especially when these materials are at low levels (e.g., 0.1% by weight).

As in the above monomercaptan epoxide reactions, polymercaptans of the formula $R(SH)_p$ wherein p is from 2 to 6, (preferably 2 to 4, more preferably 2) can be reacted with epoxides to form compounds conforming for the most part to the formula Formula IV

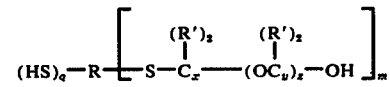

wherein $q$ is $p - m$ and can be from 0 to 4; $m$ can vary up to 6 and usually is equal to $p$ (preferably $p$ and $m$ are 2 and $q$ is zero when polymercaptans are used); and R, R′, $x$, $y$ and $z$ are as above-described.

Examples of polymercaptans include decamethylenedithiol; 2,6-dimethyloctanedithiol; octadecamethylenedithiol; 2,7-naphthalenedithiol and neopentanetetrathiol. Other useful polymercaptans may be found in the text ORGANIC CHEMISTRY OF BIVALENT SULFUR, Volume I, by E. E. Reid, 1958, published by Chemical Publishing Co., Inc. which is expressly incorporated herein by reference for its disclosures of suitable polymercaptans.

As noted above, this invention is not limited to any particular route in the preparation of the hydroxy thioethers. As an alternative route, the hydroxy thioethers of this invention can also be prepared from the reaction of a mono- or polyunsaturate, (e.g., an olefin) and a mercapto alcohol. Thus, for example, 2-mercapto ethanol may be reacted with 1-decene to form 2-hydroxy ethyl n-decyl sulfide. Also, other mercapto alcohols of the formula

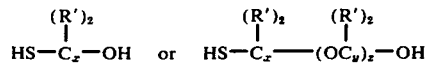

wherein $x$, $y$, $z$ and R′ are as above-described can be used to form hydroxy thioethers within the scope of this invention. Reaction conditions for this reaction along with other alternative routes for the preparation of hydroxy thioethers of this invention can be found in ORGANIC CHEMISTRY OF BIVALENT SULFUR, Volume II, by E. E. Reid, 1960, published by Chemical Publishing Co., Inc., which is incorporated herein by reference for its relevant disclosure of the preparation of hydroxy thioethers from such unsaturates and mercapto alcohols.

The hydroxy thioethers of this invention are oil-soluble or stably dispersible materials. Oil-soluble or stably dispersible as that terminology is used herein does not necessarily indicate that the materials are soluble, miscible, or capable of being suspended in oil in all proportions. It does mean, however, that the hydroxy thioethers, for instance, are soluble or stably dispersible in oil to an extent sufficient to contribute oxidation stability in the environment in which the oil is employed. Thus, while certain of the hydroxy thioethers of this invention may not be soluble or stably dispersible at all levels in lubricating oils, they are soluble or stably dispersible at levels sufficient to contribute to the oxidation stability of the lubricating oil. Moreover, the additional incorporation of a dispersant and/or other additives may also permit incorporation of higher levels of a particular hydroxy thioether, if desired. Generally, however, the hydroxy thioethers alone should be soluble or stably dispersible to the extent of at least about 0.01% by weight, preferably at least about 0.1% by weight, at 25° C., in the particular lubricating base oil employed.

The hydroxy thioethers of this invention are employed in lubricating compositions at levels from about 0.01% to about 20% or higher by weight of the total weight of the final lubricating oil composition. Preferably, the hydroxy thioethers comprise from about 0.1% to about 10% by weight of the total weight of the final lubricating oil composition. Generally, the hydroxy thioethers are used in amounts sufficient to improve the oxidative stability and/or antiwear properties of the lubricating composition under high temperature lubricating conditions. Thus, for example, in automatic transmission fluids the amount of hydroxy thioether will be normally from about 0.1% about 10% by weight whereas certain diesel lubricating compositions may require amounts of up to 10% by weight or higher.

The lubricating compositions of this invention preferably contain one or more lubricating oil dispersants. These dispersants are characterized by their ability to suspend and/or disperse sludge etc. in lubricating compositions and are oil-soluble or stably dispersible in lubricating compositions at the proportions and in the environment employed.

The dispersants, when employed, are used at a level of from about 0.01% to about 20% by weight or higher depending on such factors as the nature of the dispersant and nature of the lubricating oil. Usually, such dispersants are employed at a level of from about 0.1% to about 15% by weight. These percentages refer to the percent by weight based on the total weight of the final lubricating oil composition.

The terminology "dispersant" as used in the present specification and claims refers to those materials selected from the group consisting of (A) high molecular weight acylated nitrogen-based dispersants; (B) high molecular weight ester-based dispersants; (C) high molecular weight Mannich-based dispersants; (D) high molecular weight hydrocarbyl amine-based dispersants; (E) post-treated products of one or more of (A) through (D); (F) interpolymeric dispersants having repeating pendant groups of up to about 24 carbon atoms; and (G) mixtures of two or more of any of the dispersants included in (A) through (F). Preparation and use of these dispersants are generally known in the art.

A. High molecular weight acylated nitrogen-based dispersants

These dispersants can be generally characterized as materials having at least one high molecular weight oil-solubilizing group which is a hydrocarbon-based group ordinarily having at least about 30 aliphatic carbon atoms and further characterized as having at least one nitrogen atom directly attached to a polar group.

The dispersants of Class (A) are usually complex mixtures whose precise composition is not readily identifiable. Accordingly, such dispersants are frequently described in terms of a method of preparation. Examples of dispersants of Class (A) are described in many U.S. patents including:

| | | |
|---|---|---|
| 3,172,892 | 3,341,542 | 3,630,904 |
| 3,215,707 | 3,444,170 | 3,632,511 |
| 3,219,666 | 3,448,048 | 3,787,374 |
| 3,272,746 | 3,454,607 | 3,804,763 |
| 3,316,177 | 3,541,012 | 3,836,470 |

The above U.S. patents are expressly herein incorporated by reference for their teaching of preparation and use of dispersants within Class (A).

A convenient route in the preparation of dispersants of Class (A) comprises the reaction of a "carboxylic acid acylating agent" with a nitrogen-containing compound such as an amine, either alone, or in further combination with an organic hydroxy compound. As used herein, "carboxylic acid acylating agent" describes an acid or derivatives thereof such as an anhydride, acid halide, ester, amide, imide or amidine or the like. These carboxylic acid acylating agents have been described previously in detail. They include monocarboxylic acid acylating agents or polycarboxylic acid acylating agents.

Monocarboxylic and polycarboxylic acid acylating agents have been described, for example, in U.S. Pat. Nos. 3,087,936; 3,163,603; 3,172,892; 3,189,544; 3,219,666; 3,272,746; 3,288,714; 3,306,907; 3,331,776; 3,340,281; 3,341,542; 3,346,354; 3,381,022 and 3,755,169. For the sake of brevity, these patents are incorporated herein by reference for their teaching of the preparation and use of mono and polycarboxylic acid acylating agents. Preferred acylating agents usually contain at least about 50 aliphatic carbon atoms in the substituent atoms.

The preparation of typically useful monocarboxylic acid acylating agents is disclosed in U.S. Pat. No. 3,833,624 in columns 2–4, lines 51–73, 1–75, and 1–35, respectively. This disclosure is expressely herein incorporated by reference for its teaching of monocarboxylic acid acylating agents, their preparation and use. U.S. Pat. No. 3,697,428 discloses polycarboxylic acid acylating agents at columns 2–4, lines 21–72, 1–75, and 1–48, respectively. This disclosure is also expressly herein incorporated by reference for its teaching of the preparation and use of polycarboxylic acid acylating agents. Typically, these mono- and polycarboxylic acid acylating agents are conveniently formed from halogenated olefin polymers which are reacted with $\alpha,\beta$-unsaturated acids, anhydrides, esters and the like.

Preferred carboxylic acid acylating agents are mono and dicarboxylic acid acylating agents corresponding to compounds such as hydrocarbon-based substituted acrylic acids and hydrocarbon-based substituted succinic anhydrides or acids.

Useful nitrogen-containing compounds for the preparation of dispersants of Class (A) include mono- and polyprimary or secondary amines, characterized by a radical having the configuration $$-\overset{|}{N}-H\,.$$

The two remaining valences of the nitrogen atom of the >N—H radical preferably are satisfied by hydrogen, amino, substituted amino, or organic radical bonded to said nitrogen atom through a direct carbon-to-nitrogen linkage. These amines include ammonia, aliphatic monoamines and polyamines, hydrazines, aromatic amines, heterocyclic amines, carboxylic amines, arylene amines, alkylene amines, N-hydroxyalkyl substituted amines and the like. Usually alkylene polyamine containing two or three carbon atoms in the alkylene moieties and from two to ten amino nitrogen atoms having one or two hydrogens per amino nitrogen will be used. The ethylene polyamines such as diethylene triamine, tetraethylene polyamine, and mixtures thereof including commercial mixtures containing piperazine, aminoethoxy piperazines, etc., are preferred.

Further examples of such amines appear in U.S. Pat. No. 3,879,308 at columns 10 and 11, lines 11–68, and 1–53. This disclosure of typically useful amines is expressly herein incorporated by reference. Other types of amines including specific examples are disclosed, of course, in the above patents relating to high molecular weight acylated nitrogen-based dispersants.

The reaction between the nitrogen-containing compounds (e.g., amine) and the carboxylic acid acylating agent results in the direct attachment of a nitrogen atom to a polar radical derived from the acylating group. The linkage formed between the nitrogen atom and the polar radical may be characterized as an amide, imide, amidine, salt or mixtures of these radicals. The exact relative proportions of these radicals in a particular product may not be precisely known since it depends to a large extent upon the acylating agent, nitrogen compound and the conditions under which the reaction is carried out. For example, a reaction involving an acid or an anhydride with amines at temperatures below about 50° C., will result predominantly in a salt linkage. However, reactions at relatively higher temperatures, e.g., above 80° C. and up to about 250° C. or higher results in predominantly an imide, amide, amidine linkage or mixtures thereof.

Generally, however, the dispersants of class (A) may be characterized in that they contain at least one acyl, acyloxy or acylimidoyl group having at least about 50 carbon atoms which is bonded directly to a nitrogen.

The structures of these groups, as defined by the International Union of Pure and Applied Chemistry, are as follows: (R representing a monovalent hydrocarbon-based group or similar group);

Acyl ; $R-\overset{\overset{\displaystyle O}{\|}}{C}-$

Acyloxy ; $R-\overset{\overset{\displaystyle O}{\|}}{C}-O-$

Acylimidoyl ; $R-\overset{\overset{\displaystyle N-}{\|}}{C}-$

The high molecular weight acylated nitrogen-based dispersants of Class (A) can also contain other polar groups. For example, the carboxylic acid acylating agent can be reacted with a polyhydric alcohol and thereafter be reacted with an amine. Such a high molecular weight acylated nitrogen-based dispersant is described in U.S. Pat. No. 3,836,470. Alternatively, for example, a polycarboxylic acid acylating agent can be reacted with, for example, an alkylene polyamine, and the resulting reaction product contacted with certain polyhydric alcohols. Such acylated nitrogen-based dispersants are described in U.S. Pat. No. 3,632,511. These latter two U.S. patents are expressly incorporated herein by reference for their disclosure of the preparation and use of such dispersants.

For better understanding of the high molecular weight acylated nitrogen-based dispersants, several specific examples of such dispersants are set forth in Table I.

TABLE I

| Example | Carboxylic acid acylating agent (I) | Nitrogen containing compound (e.g. amine) (II) | Ratio of equivalents, I:II | Reaction temperature, ° C. |
|---|---|---|---|---|
| 1 | Polyisobutenyl (mol. wt.* about 900) succinic anhydride prepared from chlorinated polyisobutene | Polyethylene amine mixture containing 3–7 amino groups per molecule | 0.48 | 150 |
| 2 | Same as Example 1 | Commercial pentaethylene hexamine | 0.41 | 150 |
| 3 | Like Example 1 except polyisobutene mol. wt.* is about 1050 | Commercial pentaethylene hexamine | 0.61 | 150 |
| 4 | Like Example 1, except polyisobutene mol. wt.* is about 850 | Diethylene triamine | 1.0 | 150 |
| 5 | Same as Example 4 | Ethylene diamine | 1.0 | 150 |
| 6 | Same as Example 4 | Di-(1,2-propylene)triamine | 1.0 | 180–190 |
| 7 | Same as Example 4 | N-(2-hydroxyethyl)-trimethylene diamine | 1.06 | 150–155 |
| 8 | Same as Example 1 | 20 parts (by weight) amine mixture of Example 1, 80 parts triethylene tetramine | 0.91 | 150 |
| 9 | Same as Example 1 | Same as Example 1 | 1.33 | 150 |
| 10 | Like Example 1, except polyisobutene mol. wt.* is about 1100 | Pentaerythritol, followed by polyethylene amine of Example 1 (ratio of equivalents of alcohol to amine 7.7:1) | 0.44 | 150–210 |

*Number average molecular weights as determined by Vapor Phase Osmometry

B. High molecular weight ester-based dispersants

The high molecular weight ester-based dispersants can be generally characterized as containing at least one hydrocarbon-based group having at least about 30 aliphatic carbon atoms and further characterized as having at least one ester group. For convenience of description, these high molecular weight ester-based dispersants of Class (B) are substantially free of groups formed by the reaction of an amino nitrogen with an acylating agent inasmuch as such dispersants are included in Class (A) above.

The dispersants of Class (B) are well known in the art. Exemplary of such dispersants are those disclosed in the following U.S. patents:

| | |
|---|---|
| 3,381,022 | 3,697,428 |
| 3,522,179 | 3,833,624 |
| 3,542,678 | 3,838,052 |
| 3,542,680 | 3,879,308 |
| 3,576,743 | |

These patents are herein expressly incorporated by reference for their teaching of the use and preparation of high molecular weight ester-based dispersants.

The dispersants of Class (B) are ordinarily complex mixtures of ester-containing materials whose precise composition and or structure is not often readily identifiable. Accordingly, such dispersants of Class (B) are frequently described in terms of their method of preparation.

The dispersants of Class (B) are generally prepared by the reaction of a carboxylic acid acylating agent as described above in Class (A) with an organic mono- or poly-hydroxy compound. Moreover, included within the dispersants of Class (B) are those materials prepared by the reaction of a carboxylic acid acylating agent with a mono or polyhydroxy compound which is thereafter again reacted with a carboxylic acid acylating agent. Typically useful organic mono- and polyhydroxy compounds are quite diverse in structure.

The hydroxy compounds may be aliphatic monohydric and polyhydric alcohols and aromatic hydroxy compounds such as phenols and napthols. The monohydric alcohols include methanol, ethanol, isooctanol, dodecanol, cyclohexanol, eicosanol, neopentyl alcohol, isobutyl alcohol, and the like. The polyhydric alcohols will normally contain from 2 to about 10 hydroxy radicals. These polyhydric alcohols are illustrated by, for example, ethylene glycol, diethylene glycol, triethylene glycol, tetraethylene glycol, dipropylene glycol, and other alkylene glycols in which the alkylene radical contains from about 2 to about 8 carbon atoms. Other useful polyhydric alcohols include glycerol monooleate of glycerol, monostearate of glycerol, monomethyl ether of glycerol, pentaerythritol, 9,10-dihydroxy steric acid, sorbitol, mannitol, 1,2-cyclohexanediol, and the like. Carbohydrates with free hydroxy groups such as sugars, starches, and celluloses, are useful in the preparation of a high molecular weight ester-based dispersants of Class (B). These carbohydrates may be exemplified by glucose, fructose, sucrose, mannose, and galactose.

Typically useful mono- and polyhydroxy aromatic compounds include those wherein the aromatic nucleus of the aromatic compound is a benzene ring or an aromatic condensed hydrocarbon ring such as naphthalene. Monohydroxy and polyhydroxy phenols and naphthols are especially useful hydroxy aromatic compounds. Exemplary of such mono- and polyhydroxy aromatic compounds are those disclosed in U.S. Pat. No. 3,542,680 which is expressly herein incorporated by reference for its disclosure of high molecular weight ester-based dispersants utilizing mono- and polyhydroxy aromatic compounds.

Preferred organic hydroxy compounds include those which are polyhydric aliphatic alcohols containing up to 10 carbon atoms. Within this class are an especially preferred class of polyhydric alcohols including polyhydric alkanols containing 3 to 10, and more preferably 3 to 6 carbon atoms, and having at least 3 hydroxyl groups. Such alcohols are exemplified by glycerol; β-hydroxymethyl-2-methyl-1,3-propanediol (i.e., TME); 2-hydroxymethyl-2-ethyl-1,3-propanediol (i.e., TMP); 1,2,4-butanetriol, 1,2, 6-hexanetriol; 1,2,3-pentanetriol; and the like. For a better understanding of these high molecular weight ester-based dispersants specific examples of such dispersants are set forth in Table II.

TABLE II

| Example | Carboxylic acid acylating agent | Organic hydroxy compound | Weight ratio of acylating agent to organic hydroxy compound | Reaction temperature, °C. |
|---|---|---|---|---|
| 11 | Polyisobutylene (mol. wt.* about 1000) acrylic acid prepared from chlorinated polyisobutylene and acrylic acid | sorbitol | 81:5 | 115–205 |
| 12 | Polyisobutylene (mol. wt.* about 1100–1130) succinic anhydride prepared from chlorinated polyisobutylene and maleic anhydride | 2-hydroxymethyl-2-ethyl-1,3-propanediol (TMP) and; pentaerythritol at 1:1 ratio by weight | 397:96 | 170–220 |
| 13 | Polyisobutylene (mol. wt.* about 1025) succinic anhydride prepared from chlorinated polyisobutylene and maleic anhydride | phenol | 514:141 | 153 |
| 14 | Polyisobutylene (mol. wt.* about 1000) succinic anhydride prepared from chlorinated polyisobutylene and maleic anhydride | butyl 9, 10-hydroxystyrearate | 525:422 | 110–200 |

*Number Average Molecular Weight as determined by Vapor Phase Osmometry

C. High molecular weight Mannich-based dispersants

The dispersants of Class (C) can be characterized as reaction products of alkyl phenols in which the alkyl group contains at least about 30 carbon atoms with lower aliphatic aldehydes (especially formaldehyde) and amines (especially polyalkylene polyamines). These dispersants are well known in the art and are described in the following U.S. patents.

| | |
|---|---|
| 3,169,516 | 3,725,277 |
| 3,413,347 | 3,736,357 |
| 3,448,047 | 3,772,359 |

-continued

| | |
|---|---|
| 3,591,598 | 3,798,165 |
| 3,649,229 | 3,872,019 |

These patents are herein expressly incorporated by reference for their teaching of the preparation and use of Mannich-based dispersants.

High molecular weight Mannich-based dispersants are often complex mixtures whose precise composition is not readily identifiable. Accordingly, these materials are frequently described in terms of their method of preparation. Thus, for example, a hydroxy aromatic compound is reacted with a carbonyl compound and a compound containing at least one primary or secondary amino group to form the dispersants within Class (C).

Representative high molecular weight alkyl substituted phenols include polypropylene substituted phenol, polybutylene substituted phenol, polyamylene substituted phenol and similarly substituted phenols. In place of the phenol, high molecular weight alkyl substituted compounds of resorcinols, hydroquinones, catechols, cresols, xylenols and the like, can be employed.

Typical aldehydes are the aliphatic aldehydes, such as formaldehyde, acetaldehyde, and β-hydroxybutraldehyde; aromatic aldehyde, such as benzaldehyde; heterocylic aldehydes, such as furfural; etc. Preferred aldehydes are however, aliphatic aldehydes with formaldehyde being particularly preferred.

Useful amines include those which contain an amino group characterized by the presence of at least one active hydrogen atom. Typical amines are the alkylene polyamines such as ethylene diamine, propylene diamine; polyalkylene polyamines such as diethylene triamine, triethylene tetramines hydroxy amines such as hydroxy substituted alkylene amines and polyalkylene polyamines, and the aromatic amines such as o-, m-, and p-phenylamines. Heterocyclic amines which are suitable are those characterized by attachment of a hydrogen atom to a nitrogen atom in heterocyclic group. Representative of these amines are morpholine, thiomorpholine, imadazoline, and piperidine.

Typical specific examples of the dispersants of Class (C) are found in the above cited patents disclosing Mannich-based dispersants.

D. Hydrocarbyl amine-based dispersants

The dispersants of Class (D) can be generally characterized as high molecular weight materials having at least one amino moiety attached to a hydrocarbyl group of at least about 30 carbon atoms. Mineral acid salts of these amines are also included in Class (D) as, for example, those dispersants in U.S. Pat. No. 3,573,010. These dispersants are well known in the art. The following U.S. patents are exemplary of the preparation and use of such dispersants and are herein incorporated by reference:

| | |
|---|---|
| 3,275,554 | 3,671,511 |
| 3,373,112 | 3,755,433 |
| 3,438,757 | 3,822,209 |
| 3,454,555 | 3,869,514 |
| 3,565,804 | 3,873,460 |
| 3,573,010 | |

The dispersants of Class (D) can be readily prepared by combining an aliphatic or alicyclic halide with the desired amine in appropriate molar proportions. The halide can be derived from a hydrocarbon by halogenation and the hydrocarbon is usually derived from the free radical or ionic polymerization of olefins containing from about 2 to 6 carbon atoms. Typical olefins which find use are propylene, isobutylene, 1-pentene, and 4-methyl-1-pentene. Usually preferred olefins are propylene and isobutylene.

Typical hydrocarbyl amine dispersants conform for the most part to the formula

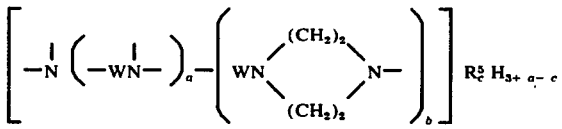

wherein W is alkylene from 2 to 6 carbon atoms; $a$ is an integer from 0 to 10; $b$ is an integer of 0 to 1; $a + 2b$ is an integer from 1 to 10; $c$ is an integer or fractional number (when averaged over the entire composition) in a range from 1 to 5; and $R^5$ is a hydrocarbyl group of at least about 30, preferably 60 to 200 aliphatic carbon atoms. Thus, these high molecular weight hydrocarbyl amines include mono and polyamines substituted with at least one high molecular weight hydrocarbyl group. The amines of Class (D) can be hydroxy substituted amines as well.

E. Post-treated products of Classes (A), (B), (C) and (D)

The dispersants of Classes (A)–(D) can be post treated with such reagents as urea, thiourea, carbon disulfide, aldehyde, ketones, anhydrides, nitriles, epoxides, boron compounds, metal salts, phosphorus compounds and the like to form oil-soluble or stably dispersible dispersants. Exemplary materials of this kind are described in the following U.S. patents:

| | | | |
|---|---|---|---|
| 3,036,003 | 3,281,428 | 3,502,677 | 3,639,242 |
| 3,087,936 | 3,282,955 | 3,513,093 | 3,649,229 |
| 3,200,107 | 3,367,943 | 3,533,945 | 3,697,574 |
| 3,216,936 | 3,403,102 | 3,539,633 | 3,702,757 |
| 3,254,025 | 3,455,831 | 3,579,450 | 3,703,536 |
| 3,256,185 | 3,455,832 | 3,591,598 | 3,704,308 |
| 3,278,550 | 3,493,520 | 3,600,372 | 3,912,641 |

These patents are incorporated herein by reference for their teaching of the preparation and use of post treated dispersants of Classes (A)–(D).

F. Interpolymeric dispersants having repeating pendent polar groups of up to about 24 carbon atoms These dispersants of class (F) can be characterized as materials which normally can serve to improve the viscosity index of lubricating compositions and also function as dispersants. the repeating pendant polar groups are normally oil-solubilizing groups (i.e., function to enhance the solubility of the interpolymeric dispersant in oil).

The interpolymeric dispersants are generally used in combination with any of the dispersants of classes (A)–(E) above, but may be used alone in the lubricating compositions without other dispersants. The interpolymeric dispersants are distinguished from the dispersants of classes (A)–(E) by the repeating character of the pendant polar groups. The interpolymeric dispersants also normally do not contain aliphatic carbon chains of over about 24 carbon atoms. Many examples of these materials are known to those in the art. Some of these examples are in U.S. Patents:

| | |
|---|---|
| 3,329,658 | 3,666,730 |
| 3,449,250 | 3,687,849 |
| 3,519,565 | 3,702,300 |
| | 3,933,761 |

which are herein incorporated by reference for their teaching of the preparation and use of interpolymeric dispersants having repeating pendant polar groups of up to about 24 carbon atoms. A preferred type interpolymeric dispersant is that type of dispersant disclosed in U.S. Pat. No. 3,702,300 (above) which is a nitrogen-containing mixed alkyl ester of a styrene-maleic anhydride copolymer having mixed-ester radicals of from 1 to 24 carbon atoms.

G. Mixtures of dispersants of Classes (A)–(F)

Mixtures of one or more dispersants from those within any of the Classes (A) through (F) can also be employed, especially and preferably combinations of boron post-treated dispersants with other dispersants.

In a preferred aspect of this invention the lubricating compositions comprise a hydroxy thioether in combination with a boron-containing dispersant. Boron-containing dispersants have been disclosed in the prior art as being useful in lubricating compositions. Typical of these boron-containing dispersants are those disclosed in the following U.S. patents:

| U.S. Patents — Dispersant type |
|---|
| 3,000,916 borated, acylated nitrogen-based |
| 3,087,936 borated, acylated nitrogen-based |
| 3,254,025 borated, acylated nitrogen-based |
| 3,281,428 borated, acylated nitrogen-based |
| 3,282,955 borated, acylated nitrogen-based |
| 3,306,908 borated, acylated nitrogen-based |
| 3,344,069 borated, acylated nitrogen-based |
| 3,449,362 borated, acylated nitrogen-based |
| 3,666,662 borated, acylated nitrogen-based |

-continued

| U.S. Patents — Dispersant type |
|---|
| 3,533,945 borated, ester-based |
| 3,442,808 borated, Mannich-based<br>3,539,633 borated, Mannich-based<br>3,697,574 borated, Mannich-based<br>3,703,536 borated, Mannich-based<br>3,704,308 borated, Mannich-based<br>3,751,365 borated, Mannich-based |
| 3,658,836 borated, hydrocarbyl amine-based |

These patents are hereby incorporated by reference for their disclosure regarding the preparation and use of boron post-treated dispersants.

Particularly preferred of the boron-containing dispersants are boron post-treated acylated nitrogen-based dispersants described in U.S. Pat. Nos. 3,087,936 and 3,254,025 which are herein incorporated by reference for their relevant disclosure of the preparation and use of such dispersants. These dispersants are nitrogen and boron-containing compositions obtained by treating an acylated nitrogen-based dispersant (see the description of Class (A) above) characterized by the presence within its structure of (a) a hydrocarbon-based substituted succinic radical selected from the class consisting of succinoyl, succinimidoyl, succinoyloxy radicals wherein the hydrocarbon-based substituent contains at least about 50 aliphatic carbon atoms and (b) a nitrogen-containing group characterized by a nitrogen atom attached directly to the succinic radical, with a boron compound selected from the group consisting of boron oxide, boron halide, boron acids, and esters of boron acids in an amount to provide from about 0.1 atomic proportion of boron for each mole of the acylated nitrogen-based dispersant to about 10 atomic proportions of boron for each atomic proportion of nitrogen of the acylated nitrogen-based dispersant.

Especially preferred boron-containing dispersants are prepared by forming an acylated nitrogen-based intermediate by the reaction at a temperature within the range from about 80° to about 250° C., of a substantially aliphatic olefin polymer-substituted succinic acid acylating agent having at least about 50 aliphatic carbon atoms in the polymer substituent with at least about one-half of an amine equivalent for each equivalent of the acylating compound used, selected from the group consisting of alkylene amines and hydroxy-substituted alkylene amines, and reacting, at a temperature between about 50° C. and about 250° C., the high molecular weight acylated nitrogen intermediate with a boron compound selected from the group consisting of boron oxide, boron halide, boron acids, and esters of boron acids in an amount to provide a boron content as specified hereinabove. Particularly preferred among this subclass of boron-containing dispersants are those where the hydrocarbon subsituents of (a) is a polyisobutene having a number average molecular weight of about 700 to about 5000 as determined by vapor phase osmometry.

The combination of the boro-containing dispersants with the hereinbefore disclosed preferred hydroxy thioethers are especially suitable for lubrication of automatic transmission systems. The lubricating environment of many of these systems is such that the lubricating composition comes in contact with surfaces comprising corrosion-susceptible materials including silver/copper alloys, bronze, copper/lead alloys and the like.

More particularly, a recent problem in certain automatic transmission systems is the deleterious effects of certain conventional automatic transmission lubricating compositions on the silver/copper-containing solder used to weld coolant pipes. Corrosion of the silver/copper-containing solder can be a particularly serious problem when certain conventional compositions are used but can be minimized by employment of the preferred combination of boron-containing dispersant and the hydroxy thioethers disclosed herein. Thus, in its particularly preferred aspects, this invention is directed to improvement of automatic transmission fluids, especially those which normally come into contact with corrosion-susceptible lubricating surfaces such as silver/copper-containing alloys.

While, as can be seen, the preferred lubricating compositions of this invention are particularly suitable for many modern automatic transmission systems whose surfaces comprise corrosion-susceptible materials, the lubricating compositions in their broader aspects are also beneficial for a variety of other types of lubricating systems. Moreover, the lubricating compositions can be based upon diverse oils of lubricating viscosity, including natural and synthetic oils and mixtures thereof.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal of shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1octenes), poly(1-decenes), etc. and mixtures thereof]; alkylbenzenes (e.g., dodecylbenzenes, tetradecylbenzenes, dinonylbenzenes, di(2-ethylhexyl)benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like. Alkylene oxide polymers and interpolymers and derivatives thereof where the terminal hydroxyl groups have been modified by esterification, etherifications, etc. constitute another class of known synthetic lubricating oils. These are exemplified by the oils through polymerization of ethylene oxide or propylene oxide, the alkyl and aryl ethers of these polyoxyalkylene polymers (e.g., methyl-polyisopropylene glycol either having an average molecular weight of 400, diphenyl ether of polyethylene glycol having a molecular weight of about 500, diethyl ether of polypropylene glycol having a molecular weight of about 300–500, etc.) or mono- and polycarboxylic esters thereof, for example, the acetic acid esters, mixed $C_3$-$C_8$ fatty acid esters, or the $C_{13}$ Oxo acid diester of tetraethylene glycol.

Another suitable class of synthetic lubricating oils comprises the esters of mono- and dicarboxylic acids (e.g., isostearic acid, neo-decanoic acid, 2-octyl-dodecanoic acid, phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritrol, dipentaerythritol, tripentaerythritol, etc.

Silicon-based oils such as the polyalkyl-, polyaryl-, polyalkoxy-, or polyaryloxy-siloxane oils and silicate oils comprise another usefull class of synthetic lubricants (e.g., tetraethyl silicate, tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy)-disiloxane poly(methyl)siloxanes, poly-(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricating compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The lubricating compositions of this invention can be used in combination with still other lubricant additives known in the prior art. A brief survey of conventional additives for lubricating compositions is contained in the publications LUBRICANT ADDITIVES, by C. V. Smalheer and R. Kennedy Smith, published by the Lezius-Hiles Company, Cleveland, Ohio (1967) and LUBRICANT ADDITIVES, by M. W. Raney, published by Noyes Data Corporation, Parkridge, New Jersey (1973). These publications are incorporated herein by reference to establish the state of the art in regard to identifying both general and specific types of other additives which can be used in conjunction with the additives of the present invention.

In general, these additional additives include (besides the hereinbefore dispersants) such additive types as ash-containing detergents, viscosity index improvers, pour point depressants, anti-foam agents, extreme pressure agents, anti-wear agents, rust-inhibiting agents, other oxidation inhibitors, and corrosion inhibitors.

The ash-containing detergents are well known. They comprise basic alkali or alkaline earth metal salts of sulfonic acids, carboxylic acids or organo-phosphorus-containing acids. The most commonly used salts of these acids are sodium, potassium, lithium, calcium, magnesium, strontium, and barium salts. Potassium and barium salts are used most extensively as compared to the others. The "basic salts" are those metal salts known to the art where the metal is present in a stoichiometrically larger amount than necessary to neutralize the acid. Potassium- and barium-overbased petrosulfonic acids are typical examples of such basic detergent salts. Ash-containing detergents can replace the above-described dispersants in whole or in part in the lubricating compositions.

Extreme pressure agents, corrosion inhibiting agents and oxidation inhibiting agents, are exemplified by chlorinated aliphatic hydrocarbons, such as chlorinated wax; organic sulfides and polysulfides, such as benzyl-disulfide, bis-(chlorobenzyl) disulfide, dibutyltetrasulfide, sulfurized sperm oil, sulfurized methyl ester of oleic acid, sulfurized terpene, sulfurized Diels Alder adducts, and the like; phosphosulfurized hydrocarbons, such as the reaction product of phosphorus sulfide with turpentine or methyl oleate; phosphorus esters such as dihydrocarbon and trihydrocarbon phosphates, i.e., dibutyl phosphite, diheptyl phosphite, dicyclohexylphosphite, dipentyl phenyl phosphite, tridecyl phosphite, distearyl phosphite, and polypropylene substituted phenol phosphite; metal thiocarbamates, such as zinc diocytlthiocarbamates and barium heptylphenyl dithiocarbamate; and Group II metal salts of phosphorodithioic acids such as zinc dicyclohexylphosphorodithioate and the zinc salts of phosphorodithioic acid.

Pour point depressing agents are illustrated by the polymers of ethylene, propylene, isobutylene, and poly-(alkyl methacrylic). Antifoam agents include silicones, polymeric alkyl thiooxane, poly(alkyl methacrylates), terpolymers of diacetone acrylamide and alkyl acrylates or methacrylates, and the condensation products of alkyl phenol with formaldehyde and an amine. Viscosity index improvers include polymerized and copolymerized alkyl methacrylates and mixed esters of styrene-maleic anhydride interpolymers reacted with nitrogen-containing compounds. Viscosity index improvers may also serve as dispersants in the compositions.

When additional additives are used in the lubricating compositions herein, they are used in concentrations in which they are normally employed in the art. Thus, they will generally be used in a concentration of from about 0.001% up to about 25% by weight of the total composition, depending, of course, upon the nature of the additive and the nature of the lubricating composition. For example, pour point depressant, extreme pressure additive, viscosity index improving agents, antifoaming agents and the like, are normally employed in amounts of from about 0.001% to about 10% by weight of the total composition, depending upon the nature and purpose of the particular additive.

The lubricating compositions of the present invention may, of course, be prepared by a variety of methods known in the art. One convenient method is to add the hydroxy thioether in the form of a concentrated solution or substantially stable dispersion (i.e., an additive concentrate) to a sufficient amount of a base lubricant to form the desired final lubricating oil composition. This additive concentrate contains the hydroxy thioether in proper amount to provide the desired concentration of the hydroxy thioether in the final lubricating composition when added to a predetermined amount of a base lubricant. The concentrate, of course, may also contain appropriate amounts of additional additives, such as dispersants desired to be incorporated into the final lubricating oil composition.

Generally, additive concentrates will comprise from about 10% to about 90%, usually about 20% to about 60%, (by weight) of the concentrate composition of the hydroxy thioether additive with the balance being a substantially inert, normally liquid organic solvent or diluent, and/or any additional additives as desired. Suitable solvents and diluents include any of the hereinbefore discussed natural or synthetic oils, kerosene, xylene, benzene, mixtures of two or more of these and other solvents and diluents known in the art. Normally these solvent or diluent carriers are oil-soluble at least to the extent of their concentration in their final lubricating compositions which are prepared from them. The dispersant will usually comprise from about 10% to about 80% by weight of the total concentrate composition, if present.

In the method aspect of this invention, a lubricating surface is contacted with an effective amount of a lubricating composition comprising a major amount of a lubricating oil and a minor amount of at last one additive of the formula:

$$(HS)_q-R\left[S-\overset{(R')_2}{\overset{|}{C}}_x-(O\overset{(R')_2}{\overset{|}{C}}_y)_z-OH\right]_m$$

wherein R is a hydrocarbon-based group containing up to about 30 carbon atoms and having a valence of $m + q$; each R′ is independently selected from hydrogen and a hydrocarbon-based group of up to about 20 carbon atoms; $x$ and $y$ are independently an integer of from 2 to 5; $z$ is an integer from zero to 5; $q$ is an integer from zero to 4 and $m$ is an integer from 1 to 5 with the proviso that $m + q$ is from 1 to 6. Preferred aspects of R, R′, $q$, $x$, $y$, $z$ and $m$ are as discussed above.

Lubricating surface, as used herein and in the appended claims, generally refers to any of the commonly known solid surfaces which normally come into contact with the lubricating compositions disclosed herein. Particularly contemplated herein are lubricating surfaces which have a silver/copper-containing alloy associated with the lubricating surface such that the lubricating compositions normally come into contact therewidth. Thus, lubricating surfaces of automatic transmission systems which contain silver/copper alloys are particularly contemplated herein.

These lubricating surfaces can comprise a variety of other metals including steels, bronzes, brasses, aluminum base-alloys, hardened lead, as well as other combinations of metals. They may also comprise non-metal surfaces such as plastics, including Bakelite and Teflon; nylon; glass; ceramics; paper; rubbers and the like.

The lubricating methods of this invention can be used in lubricating systems wherein the lubricating compositions can reach relatively high temperatures such as from about 80° C. to about 220° C. or higher in use. Thus, in the method aspect of this invention the lubricating systems can comprise those wherein the temperature of the lubricating composition can vary up to about 220° C. or higher for extended periods (e.g., 200 hours or longer). Typical examples of such lubricating systems are automatic transmission systems. Of course, the lubricating compositions may experience intermittently low and high temperature conditions and such temperature variations are contemplated in the method aspect of this invention. Normally, such lubricating compositions are not subjected to temperatures of greater than about 175° C. for prolonged periods.

The amount of the lubricating composition required for the lubricating methods herein is normally that amount which is conventionally used in the lubricating systems. These conventional amounts are usually specified by the manufacturer of the particular system for which the lubrication is required. Thus, the particular amount of lubricating composition employed in the method herein does not form a critical aspect of this invention as long as the lubricating composition is utilized at recommended levels. Moreover, standard texts and/or manufacturer's lubricating specification data can be consulted to determine effective amounts of a lubricating composition employed in any particular lubricating system.

The following examples provide a clear understanding of the invention herein and are intended as illustrative of the invention herein and not limiting thereof. Unless otherwise clearly indicated all "parts" and "percentages" refer to parts by weight and percent by weight respectively.

EXAMPLE 15

While allowing the temperature to increase from 40° C. to 135° C., a reaction mixuture is prepared by the addition of 580 parts (10 moles) of propylene oxide to 2020 parts (10 moles) of tertiary dodecyl mercaptan and 14 parts of a 50% aqueous solution of sodium hydroxide. The reaction mixture is refluxed at 115°–120° C. for 3 hours, stripped to 120° C. under vacuum and filtered. The filtrate (2597 parts) is the desired hydroxy thioether which is primarily the monocondensation product of the mercaptan and propylene oxide.

EXAMPLE 16

At 100° C., a reaction mixture is prepared by the addition of 1200 parts of styrene oxide to 2020 parts of tertiary dodecyl mercaptan and 14 parts of a 50% aqueous solution of sodium hydroxide. The reaction mixture is stripped to 195° C. under vacuum and filtered to yield, as the filtrate, the desired hydroxy thioether which is primarily the mono-condensation product of the mercaptan and styrene oxide.

EXAMPLE 17

A mixture of 1047 parts of n-dodecyl mercaptan and 0.8 part of sodium metal is heated to 120° C. At 120°–145° C., 305 parts of propylene oxide is added over 2½ hours. The reaction mixture is stripped to 120° C. under vacuum and filtered to yield, as the filtrate, the desired hydroxy thioether which is primarily the monocondensation product of the mercaptan and propylene oxide.

EXAMPLE 18

While maintaining the temperature at 110°–150° C., a mixture is prepared by bubbling ethylene oxide through 545 parts of tertiary dodecyl mercaptan and 2.4 parts of sodium hydroxide until a weight gain of 265 parts is obtained. The mixture is held 150°–160° C. under nitrogen for 1 hour and filtered to yield primarily the desired condensation product of the mercaptan and 2 moles of ethylene oxide as filtrate.

EXAMPLE 19

The procedure for Example 18 is repeated except the ethylene oxide weight gain is 580 parts. The filtrate is primarily the desired condensation product of 4 moles of ethylene oxide and 1 mole of the mercaptan.

EXAMPLE 20

The procedure for Example 18 is repeated except the ethylene oxide weight gain is 594 parts. The filtrate is primarily the desired product of 5 moles of ethylene oxide and 1 mole of the mercaptan.

EXAMPLE 21

At 70°–85° C., a mixture is prepared by the addition of 58 parts of propylene oxide to 167 parts of polybutene (number average molecular weight is 300 by vapor phase osmometry) mercaptan and 1.5 parts of sodium methoxide. The reaction mixture is heated at 85°–90° C. under nitrogen, then stripped to 100° C. under vacuum, filtered, to yield primarily, as the filtrate, the desired hydroxy thioether formed from 2 moles of propylene oxide and 1 mole of a mercaptan.

EXAMPLE 22

The procedure for Example 21 is repeated except ethylene oxide replaces the propylene oxide on a molar basis. The filtrate is the desired hydroxy thioether.

EXAMPLE 23

A mixture of 350 parts of decene-1 and 195 parts of 2-mercaptoethanol is stirred at 40°–60° C. for 3 hours. The reaction mixture is stripped to 100° C. under vacuum and filtered. The filtrate is primarily the desired hydroxy thioether; it contains 13.79% sulfur.

EXAMPLE 24

A mixture of 88 parts of a commercial mixture of $C_{11}$-14 alpha-olefins and 46 parts of 2-hydroxy-1-propanethiol is heated at 100°–105° C. for 9 hours. The reaction mixture is stripped to 150° C. under vacuum and filtered to yield, as the filtrate, 112 parts of a mixture of hydroxy thioether conforming for the most part to the formula $$C_{11-14}H_{23-29}SCH_2CHOHCH_3.$$

EXAMPLE 25

2,9-Para-menthanedithiol (155 parts), propylene oxide (100 parts) and sodium metal (0.05 part) are reacted according to the procedure set forth in Example 16. The filtrate obtained contains 20% sulfur and is primarily the desired condensation product of propylene oxide with each of the mercaptan moieties.

COMPOSITIONS:

EXAMPLE A

A lubricating composition suitable for use as an automatic transmission fluid, is prepared, using as the base oil, a mixture of 90% by volume of a 110N mineral oil and 10% by volume of a 200N mineral oil, and as additives, by weight; 4% of a mixed ester of a styrene-maleic anhydride copolymer reacted with a nitrogen-containing compound (prepared as in U.S. Pat. No. 3,702,300 ); 3.0% of a commercially available, proprietary seal swell agent; 1% of the reaction product of a polyisobutenyl substituted succinic anhydride, commercial tetraethylene pentamine, and boric acid prepared as in U.S. Pat. No. 3,254,025; 0.3% of a commercially available diphenylamine based oxidation inhibitor; 0.1% of a dialkyl phosphite; 0.5% of a conventional friction modifier based on polyoxyethylene (2) tallowamine; 0.3% of the filtrate of Example 15; and 3.0% of the dispersant of Example 1.

In this composition, the hydroxy thioether functions primarily to improve the oxidation stability and antiwear properties of the composition.

EXAMPLE B

In this example, the filtrate of Example 15 in Example A is replaced, on an equal weight basis, with the filtrate of Example 17.

EXAMPLE C

A lubricating composition, suitable as an automatic transmission lubricating composition, is prepared using as a base oil, a mixture of 90% by volume of a 110N mineral oil and 10% by volume of a 200N mineral oil, and as additives, by weight; 1.5% of a seal swell agent; 2.8% of the dispersant of Example 5; 1.7% of a boron-containing dispersant, the dispersant base first prepared as in Example 5 and thereafter treated with boric acid; 0.2% of a dialkyl hydrogen phosphite extreme pressure agent; 0.2% of a commercially available diphenylamine-based antioxidant; 0.3% of a sulfurized fatty ester-fatty acid-olefin mixture; 2.0% of a mixed ester of a styrene-maleic anhydride copolymer reacted with a nitrogen-containing compound (prepared as in U.S. Pat. No. 3,702,300); and 0.5% of the filtrate of Example 16.

The hydroxy thioether in this Example is used primarily for its improvement of the oxidation stability and antiwear properties of the composition.

EXAMPLE D

In this example, the hydroxy thioether in Example C is replaced with an equal amount by weight of the filtrate of Example 24 to form a lubricating composition.

EXAMPLE E

A lubricating composition suitable for use as an automatic transmission lubricating composition, is prepared using as a base oil, the oil mixture of Example A, and as additives, by weight; 3.0% of a mixed-ester of styrene-maleic anhydride copolymer reacted with a nitrogen-containing compound, prepared as in U.S. Pat. No. 3,702,300; 2.0% of a commercially available seal swell agent; 1.5% of a boron-containing dispersant prepared as in U.S. Pat. No. 3,087,618; 2% of a dispersant prepared as in Example 8; 0.2% of a hindered diphenylamine-based antioxidant; 0.2% of a dialkyl phosphite; 0.2% of a tallowamine friction modifier; .0001% of a commercial silicone-based antifoam agent; 0.4% of dialkyl hydrogen phosphite as an extreme pressure agent; 0.2% of a sulfurized fatty acid, fatty ester, olefin mixture as an antiwear agent; and 0.5% of the filtrate of Example 15.

The hydroxy thioether functions primarily to provide oxidation stability and antiwear properties.

EXAMPLE F

In this example, four different compositions are prepared by replacement of the filtrate of Example 15 in Exammple E, respectively, with, on an equal weight basis, the filtrates of Example 19; Example 20; Example 22 and Example 25.

EXAMPLE G

A lubricating composition, suitable for use as an automatic transmission fluid, is prepared using as a base oil, an alkylated aromatic synthetic lubricating oil; and, as additives, by weight; 3.0% of a boron-containing acylated nitrogen based dispersant prepared from polyisobutenyl succinic anhydride, tetraethylene pentamine and boric acid as in U.S. Pat. No. 3,254,025; 3% of a carbon disulfide post-treated dispersant prepared from polyisobutenyl succinic anhydride, tetraethylene pentamine and carbon disulfide as in U.S. Pat. No. 3,200,107; 0.5% of a sulfurized mixture of soybean oil/$C_{12}$-$C_{20}$ $\alpha$-olefins and $C_{12}$-$C_{18}$ fatty acids; 0.5% of the filtrate of Example 18; 0.1% of a di-lower alkyl hydrogen phosphite; 0.1% of a hindered amine antioxidant 0.2% of Ethomeen T/12 as a friction modifier; and 0.3% of a mineral oil.

The hydroxy thioether is used primarily to improve the oxidation stability/antiwear properties of this composition.

EXAMPLE H

A lubricating composition, suitable for use as an automatic transmission fluid is prepared using as a base oil, a mixture of 90% by volume of a 110N mineral oil and 10% by volume of a 210N mineral oil, and as additives, by weight; 3.5% of a mixed-ester of a styrene-maleic anhydride copolymer reacted with a nitrogen-containing compound prepared as in U.S. Pat. No. 3,702,300; 3.0% of a commercially available proprietary seal sweller; 0.5% of a boron-containing acylated nitrogen-based dispersant prepared as in U.S. Pat. No. 3,254,025; 0.5% of the filtrate of Example 22; 2.0% of a carbon disulfide post-treated acylated nitrogen-based dispersant prepared as in U.S. Pat. No. 3,200,107; and 0.02% of a commercially available silicone-based antifoam agent.

Those of ordinary skill in the art to which this invention pertains will, upon consideration of the foregoing, recognize many obvious modifications and equivalents of the invention. Such modifications and equivalents are intended to be part of this invention except to the extent they are excluded by the appended claims.

1. A transmission or railroad diesel lubricating composition comprising a major amount of a lubricating oil and a minor amount, sufficient to improve the oxidative stability of the lubricating composition, of one or more additives of the formula:

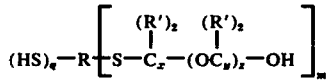

wherein R is a hydrocarbyl or substituted hydrocarbyl containing up to about 30 carbon atoms, wherein the substituents for the substituted hydrocarbyl are selected from the group consisting of halo, nitro, lower alkoxy, lower alkylthio, and

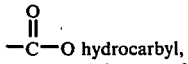

and R has a valence of $m+q$; each R′ is independently selected from hydrogen, hydrocarbyl or substituted hydrocarbyl of up to about 20 carbon atoms, wherein the substituents for the substituted hydrocarbyl are selected from the group consisting of halo, nitro, lower alkoxy, lower alkylthio, and

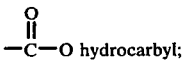

$x$ and $y$ are independently an integer of from 2 to 5; $z$ is an integer of from zero to 5; $q$ is an integer of from zero to 4; and $m$ is an integer of from 1 to 5 with the proviso that the sum of $m+q$ is from 1 to 6.

2. A composition according to claim 1 wherein $q$ is zero.

3. A composition according to claim 2 wherein R is a saturated hydrocarbon.

4. A composition according to claim 3 wherein $m$ is 1 or 2.

5. A composition according to claim 4 wherein $y$ is 2.

6. A composition according to claim 5 wherein $z$ is zero or 1.

7. A composition according to claim 6 wherein each R′ is independently hydrogen or lower alkyl.

8. A composition according to claim 7 wherein $x$ is 2 and $z$ is zero.

9. A composition according to claim 8 wherein R is an alkyl group of from about 8 to about 16 carbon atoms and $m$ is 1.

10. An automaitc transmission lubricating composition comprising a major amount of a lubricating oil and a minor amount, sufficient to improve the oxidative stability of the lubricating composition, of at least one additive of the formula:

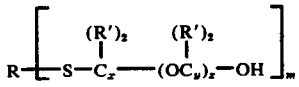

wherein R is hydrocarbyl or substituted hydrocarbyl of up to about 30 carbon atoms, wherein the substituents for the substituted hydrocarbyl are selected from the group consisting of halo, nitro, lower alkoxy, lower alkylthio, and

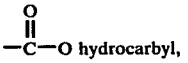

and R has a valence of $m$; each R′ is independently selected from hydrogen, hydrocarbyl or substituted hydrocarbyl of up to about 20 carbon atoms, wherein the substituents for the substituted hydrocarbyl are selected from the group consisting of halo, nitro, lower alkoxy, lower alkylthio, and

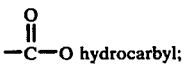

$x$ and $y$ are 2; $z$ is an integer of from zero to 5; and $m$ is an integer of 1 or 2.

11. In a transmission or railroad diesel lubricating composition comprising a major amount of a lubricating oil and from about 0.01 to about 20% by weight of the total composition of at least one dispersant, the improvement which comprise the incorporation of from about 0.01 to abut 20.0% by weight of the total composition of one or more additives of the formula:

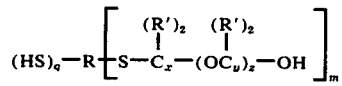

wherein R is a hydrocarbyl or substituted hydrocarbyl containing up to about 30 carbon atoms, wherein the substituents for the substituted hydrocarbyl are selected from the group consisting of halo, nitro, lower alkoxy, lower alkylthio, and

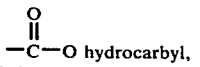

and R has a valence of $m + q$; each R′ is independently selected from hydrogen, hydrocarbyl or substituted hydrocarbyl of up to about 20 carbon atoms, wherein the substituents for the substituted hydrocarbyl are selected from the group consisting of halo, nitro, lower alkoxy, lower alkylthio, and

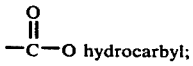

$x$ and $y$ are independently an integer of from 2 to 5; $z$ is an integer of from zero to 5; $q$ is an integer of from zero to 4; and $m$ is an integer of from 1 to 5 with the priviso that the sum of $m + q$ is from 1 to 6.

12. An improved composition according to claim 11 wherein (a) is present in an amount of from about 0.01% to about 10% by weight and (b) is present in an amount of from about 0.01% to about 20% by weight, said percentages being present by weight based on the total weight of the lubricating composition.

13. An improved composition according to claim 12 wherein $q$ is zero; R is an alkyl group of from about 8 to about 16 carbon atoms; $m$ is 1; $z$ is zero or 1; each R′ is independently selected from the group consisting of hydrogen and lower alkyl; and $x$ and $y$ are 2.

14. An improved cmposition according to claim 13 wherein the dispersant is selected from the group consisting of i. high molecular weight acylated nitrogen-based dispersants;
ii. high molecular weight ester-based dispersants;
iii. high molecular weight Mannich-based dispersants;
iv. high molecular weight hydrocarbyl amine-based dispersants;
v. post-treated products of (i), (ii), (iii), and (iv);
vi. interpolymeric dispersants having repeating pendant groups of up to about 24 carbon atoms;
vii. mixtures of two or more of any of (i), (ii), (iii), (iv), (v) and (vi).

15. An improved composition according to claim 14 wherein the dispersant comprises a high molecular weight acylated nitrogen-based dispersant.

16. An immproved composition according to claim 14 wherein the dispersant comprises high molecular weight ester-based dispersant, 17. An improved composition according to claim 14 wherein the dispersant comprises a high molecular weight hydrocarbyl amine-based dispersant.

18. An improved composition according to claim 14 wherein the dispersant comprises a high molecular weight Mannich-based dispersant.

19. An improved composition according to claim 14 wherein the dispersant comprises a boron-containing high molecular weight dispersant.

20. An improved composition according to claim 19 wherein the boron-containing dispersant is a high molecular weight acylated nitrogen-based dispersant treated with an amount of a boron compound sufficient to produce at least about 0.1 atomic proportion of boron per mole of acylated nitrogen-based dispersant.

21. A concentrate, suitable for the preparation of transmission or railroad diesel lubricating compositions, which comprises a substantially inert, normally liquid organic diluent and from about 10% to about 90% of at least one additive of the formula:

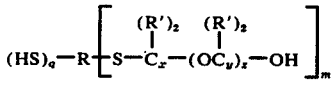

wherein R is hydrocarbyl or substituted hydrocarbyl containing up to about 30 atoms, wherein the substituents for the substituted hydrocarbyl are selected from the group consisting of halo, nitro, lower alkylthio, and

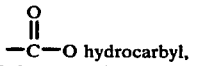

and R has a valence of $m + q$; each R′ is independently selected from hydrogen, hydrocarbyl or substituted hydrocarbyl of up to about 20 carbon atoms, wherein the substituents for the substituted hydrocarbyl are selected from the group consisting of halo, nitro, lower alkoxy, lower alkylthio, and

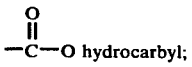

$x$ and $y$ are independently an integer of from 2 to 5; $z$ is an integer of from zero to 5; $q$ is an integer of from zero to 4; and $m$ is an integer of from 1 to 5 with the provisio that the total of $m + q$ is from 1 to 6.

22. A concentrate as in claim 21 wherein R is a saturated hydrocarbon; $m$ is 1 or 2; $x$ and $y$ are 2; $q$ is zero; $z$ is zero or 1; and each R′ is independently selected from hydrogen and lower alkyl.

23. A concentrate as in claim 21 wherein $z$ is zero; $m$ is 1; and R is an alkyl group of from 8 to about 16 carbon atoms.

24. A concentrate as in claim 22 which contains from about 10% to about 80% of a dispersant, said percent by weight being based on the total weight of the concentrate.

25. A method of lubrication in transmission or railroad diesel environments which comprises contacting a lubricating surface with an effective amount of a lubricating composition comprising a major amount of a lubricating oil and a minor amount sufficient to improve the oxidative stability of the lubricating compositon of at least one additive of the formula:

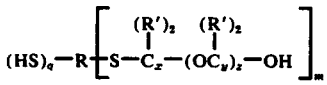

wherein R is hydrocarbyl or substituted hydrocabyl containing up to about 30 carbon atoms, wherein the substituents for the substituted hydrocarbyl are selected from the group consisting of halo, nitro, lower alkoxy, lower alkylthio, and

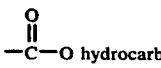

and R has a valence of $m+q$; each R′ is independently selected from hydrogen, hydrocarbyl or substituted hydrocarbyl of up to about 20 carbon atoms, wherein the substituents for the substituted hydrocarbyl are selected from the group consisting of halo, nitro, lower alkoxy, lower alkylthio, and

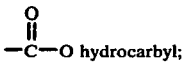

$x$ and $y$ are independently an integer of from 2 to 5; $z$ is an integer of from zero to 5; $q$ is an integer of from zero to 4; and $m$ is an integer of from 1 to 5 with the proviso that the sum of $m+q$ is from 1 to 6.

* * * * *

UNITED STATES PATENT OFFICE

CERTIFICATE OF CORRECTION

PATENT NO. : 4,031,023

DATED : June 21, 1977

INVENTOR(S) : Jerry Lee Musser and Frederick William Koch

It is certified that error appears in the above-identified patent and that said Letters Patent are hereby corrected as shown below:

At column 27 line 5, that is Claim 11 line 5, "comprise" should be -- comprises --.

At column 27 line 41, that is Claim 12 line 5, "present" should be -- percent --.

At column 28 line 28, that is Claim 21 line 8, "30 atoms" should be -- 30 carbon atoms --.

At column 28 line 30, that is Claim 21 line 10, after "nitro," insert -- lower alkoxy, --.

At column 28 line 56, that is Claim 23 line 2, "from 8" should be -- from about 8 --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*